US009045272B2

(12) United States Patent
Kim

(10) Patent No.: US 9,045,272 B2
(45) Date of Patent: Jun. 2, 2015

(54) DISPENSER FOR FOOD OR MEDICINE

(76) Inventor: Gwang-Sig Kim, Bucheon-si (KR)

( * ) Notice: Subject to any disclaimer, the term of this patent is extended or adjusted under 35 U.S.C. 154(b) by 15 days.

(21) Appl. No.: 13/980,903

(22) PCT Filed: Jan. 24, 2011

(86) PCT No.: PCT/KR2011/000468

§ 371 (c)(1),
(2), (4) Date: Jul. 22, 2013

(87) PCT Pub. No.: WO2012/099289

PCT Pub. Date: Jul. 26, 2012

(65) Prior Publication Data

US 2013/0292406 A1 Nov. 7, 2013

(30) Foreign Application Priority Data

Jan. 20, 2011 (KR) ..... 10-2011-0005862

(51) Int. Cl.
*B65H 3/00* (2006.01)
*G07F 11/24* (2006.01)
*B65D 83/04* (2006.01)

(52) U.S. Cl.
CPC ..... *B65D 83/04* (2013.01); *B65D 83/0409* (2013.01)

(58) Field of Classification Search
USPC ..... 221/277, 25, 155, 97, 203, 265, 186, 2
See application file for complete search history.

(56) References Cited

U.S. PATENT DOCUMENTS

| | | | | | |
|---|---|---|---|---|---|
| 3,804,294 | A * | 4/1974 | Householder | 221/154 |
| 4,150,766 | A * | 4/1979 | Westendorf et al. | 221/112 |
| 4,832,229 | A * | 5/1989 | Hackmann et al. | 221/25 |
| 5,280,845 | A * | 1/1994 | Leight | 221/2 |
| 5,673,813 | A * | 10/1997 | Russell | 221/203 |
| 6,241,120 | B1 * | 6/2001 | Scholey et al. | 221/186 |
| 6,604,653 | B2 * | 8/2003 | Millar | 221/203 |
| 6,637,619 | B2 * | 10/2003 | Chang | 221/24 |
| 2005/0178790 | A1 * | 8/2005 | Ishida | 221/277 |

FOREIGN PATENT DOCUMENTS

| | | | |
|---|---|---|---|
| EP | 2287087 | | 2/2011 |
| KR | 1020030040747 | | 5/2003 |
| KR | 20-0359435 | | 8/2004 |
| KR | 1020050122059 | | 12/2005 |
| KR | 2010002752 | A * | 1/2010 |
| KR | 1020100002752 | | 1/2010 |
| WO | WO 2012099289 | A1 * | 7/2012 |

* cited by examiner

*Primary Examiner* — Rakesh Kumar
(74) *Attorney, Agent, or Firm* — IPLA P.A.; James E. Bame

(57) ABSTRACT

A dispenser for food or medicine is provided to store contents such as food or medicine inside and discharging one or a certain amount of food or medicine at a time and improves productivity of components and convenience for assembly by improving a cover which has an elastic piece and a button and a rod formed in one body and improving a coupling structure of a blocking member, a base plate, and a cylindrical main body to a protrusion and a groove type coupling.

2 Claims, 7 Drawing Sheets

DISPENSER FOR FOOD OR MEDICINE

BACKGROUND OF THE INVENTION

The present invention relates to a dispenser for food or medicine which is capable of storing food, such as gum and candies, or medicine inside and discharging one or a certain amount of food or medicine at a time, and more particularly, to an improved dispenser for food or medicine which is capable of reducing manufacturing costs through productivity of components and convenience in assembly and capable of conveniently discharging contents of food or medicine of a capsule type or a solid type stored inside whenever a button is pressed.

As conventional dispensers for food or medicine, there are Korean Utility Model Registration Nos. 531604, 328700 and 354242 and Korean Patent Laid-open No. 10-2005-0101583 which the inventor of the present invention had invented or devised.

The above-mentioned dispensers have a disadvantage in that they have less sealing effect because an outlet is always open. Moreover, in the case that the outlet is opened and closed by a cover additionally mounted, the dispensers have another disadvantage in that they are inconvenient in use because a user must open and close the cover besides pressing a button in order to discharge food or medicine.

In order to solve the problems of the conventional dispensers, the inventor invented a dispenser which includes: discharging means, which is mounted at an outlet of a base and is capable of slidably opening and closing the outlet; and a retaining piece formed on an inner face of the discharging means and having elasticity, whereby when the user slides the discharging means by fingers to open the outlet, the retaining piece is caught to a retaining member of a rotor so as to rotate the rotor at a certain angle, and the invention has Korean Patent No. 578035.

However, in Korean Patent No. 578035, the dispenser which has the cover slidably opened and closed has several problems in that the outlet is not perfectly sealed because edges of the cover and the outlet are not in elastic contact with each other and in that the dispenser is somewhat inconvenient in use because it discharges the contents by an action that the user pushes the cover aside to open and close the cover.

Therefore, the inventor invented another dispenser which is capable of storing contents such as food or medicine inside and discharging one or a certain amount of food or medicine at a time by simply pressing a button without the action to open and close the cover of the outlet, and which is capable of providing an excellent sealing effect while the contents are not discharged out, and the invention has Korean Patent No. 998,864.

Referring to FIG. 7 showing the structure of the dispenser with Korean Patent No. 998,864, when the user presses the button 700, the rotor 200 which is fit and joined to a central shaft 106 to the inside of a base 100 is rotated at a certain angle so as to discharge food or medicine, which is inserted into an insertion hole 202 formed in the circumference of the rotor 200, to the outlet 102 formed at one side of the base 100. In a state where retaining protrusions 704 formed at right and left of the button 700 is slidably joined to elongated holes 606 of the cover 600 which has a shaft 602 laterally protruding at the right and left upper sides and operating bars 604 upwardly protruding at right and left sides of the top and having the elongated holes 606, the shaft 602 of the cover 600 is rotatably joined to a shaft hole 110 formed at the right and left of the top of the outlet 102, so that when the cover 600 is rotated on the shaft 602 and the outlet 102 is opened when the user presses the button 700.

That is, when the user presses the button 700, the rotor 200 rotates at a certain angle, and at the same time, the retaining protrusion 704 formed on the button 700 slides inside the elongated holes 606 of the operating bars 604 formed at the upper portion of the cover 600 so as to push back the operating bars 604, the cover 600 rotates on the shaft 602 so as to open the outlet 102. When the outlet 102 is opened, the contents inserted into the insertion hole 202 of the rotor 200 moving toward the outlet 102 are discharged to the outlet 102. On the contrary, when the user releases the button 700, the button 700 returns to its original state by a coil spring 714, so that the cover 600 seals the outlet.

Furthermore, when the user presses the button 700, a push rod 702 joined to the button 700 is guided and moved by a guide 310 of a blocking member 300 so as to operate a ratchet 206 formed on the upper part of the rotor 200, and at this moment, the contents inserted into the insertion hole 202 of the rotor 200 are moved toward the outlet 102.

The dispenser in Korean Patent No. 998864 has several effects in that it discharges one or a certain amount of the contents stored inside at a time by the simply pressing action of the button 700 and in that the cover joined to the outlet is opened by the pressing action of the button 700 without any action to open and close the cover joined to the outlet and is closed so as to perfectly seal the outlet when the user releases the button 700.

However, the dispenser in Korean Patent No. 998864 has several problems in that it needs a coil spring 714 for returning the button 700 and the cover, in that it is inconvenient in fitting the button 700 into a button hole 104 because the button 700 has the retaining protrusions 704, and in that it is very difficult to fit and join the elongated holes 606 of the operating bars 604 of the cover 600 to the retaining protrusions 704 so as to excessively increase assembling expenses because the retaining protrusions 704 of the button 700 inserted into the button hole 104 are located inside the base 100 and the blocking member 300.

That is, the dispenser in Korean Patent No. 998864 is very complicated and inconvenient in assembling the operating bars 604, the coil spring 714, the button 700 and the cover 600.

SUMMARY OF THE INVENTION

Accordingly, the present invention has been made in an effort to solve the above-mentioned problems occurring in the prior arts, and it is an object of the present invention to provide a dispenser for food or medicine which is capable of storing contents such as food or medicine inside and discharging one or a certain amount of food or medicine at a time by an action to simply press a button, which provides a sealing effect while the dispenser does not discharge the contents, and which improves productivity of components and convenience in assembly by improving a cover having an elastic piece and an integrated button and push rod and improving a joining structure of a blocking member, a base plate and a cylindrical main body.

To achieve the above objects, the present invention provides a dispenser for food or medicine, which includes: a cylindrical main body for receiving contents such as food or medicine; a base plate for closing a lower end of the cylindrical main body; a rotor rotatably joined to the base plate; a blocking member arranged above the base plate and the rotor for guiding introduction of the contents into insertion recesses of the rotor and providing an outlet and an operation space for a button, a push rod and a cover; and the button, so that when a user presses the button, the contents inserted into the insertion recesses formed in the circumference of the rotor are discharged to outlets formed at sides of the cylindrical main body, the base plate and the blocking member while the rotor joined to the inside of the cylindrical main body rotates at a previously set angle, wherein the button and the push rod are formed integrally, an operation hole is formed in the upper part of the operation space of the blocking member so that the push rod slides horizontally to operate the rotor after being inserted into the operation hole, the blocking member is formed in a cylindrical shape, a plurality of ribs are formed in a vertical direction, a shaft hole to which a shaft of the cover is rotatably inserted is formed in the rib located at the outlet, and the cover has a space formed at the center in order to insert the push rod into the space and an arc-shaped elastic piece formed integrally with the front side of the cover, whereby the button, the push rod and the cover are returned to their original states by elasticity of the elastic piece and the cover is rotated to open the outlets when a user presses the button.

The dispenser for food or medicine according to the present invention can discharge the contents stored inside one by one or consecutively because the cover joined to the outlet is opened by the simply pressing action of the button without any action to open and close the cover joined to the outlet and can prevent oxidation or pollution of the contents because the cover is closed to perfectly seal the outlet when the user releases the button. Moreover, the dispenser improves productivity of the components and convenience in assembly by reducing the number of the components because the button and the push rod are formed integrally and the elastic piece is integrated to the cover. Furthermore, the dispenser increases convenience in assembly because the blocking member, the base plate and the main body are joined together through a protrusion-groove structure.

Additionally, the dispenser according to the present invention can improve the sealing effect of the outlet in the case that a distortion spring is added to the cover.

Figure 1:
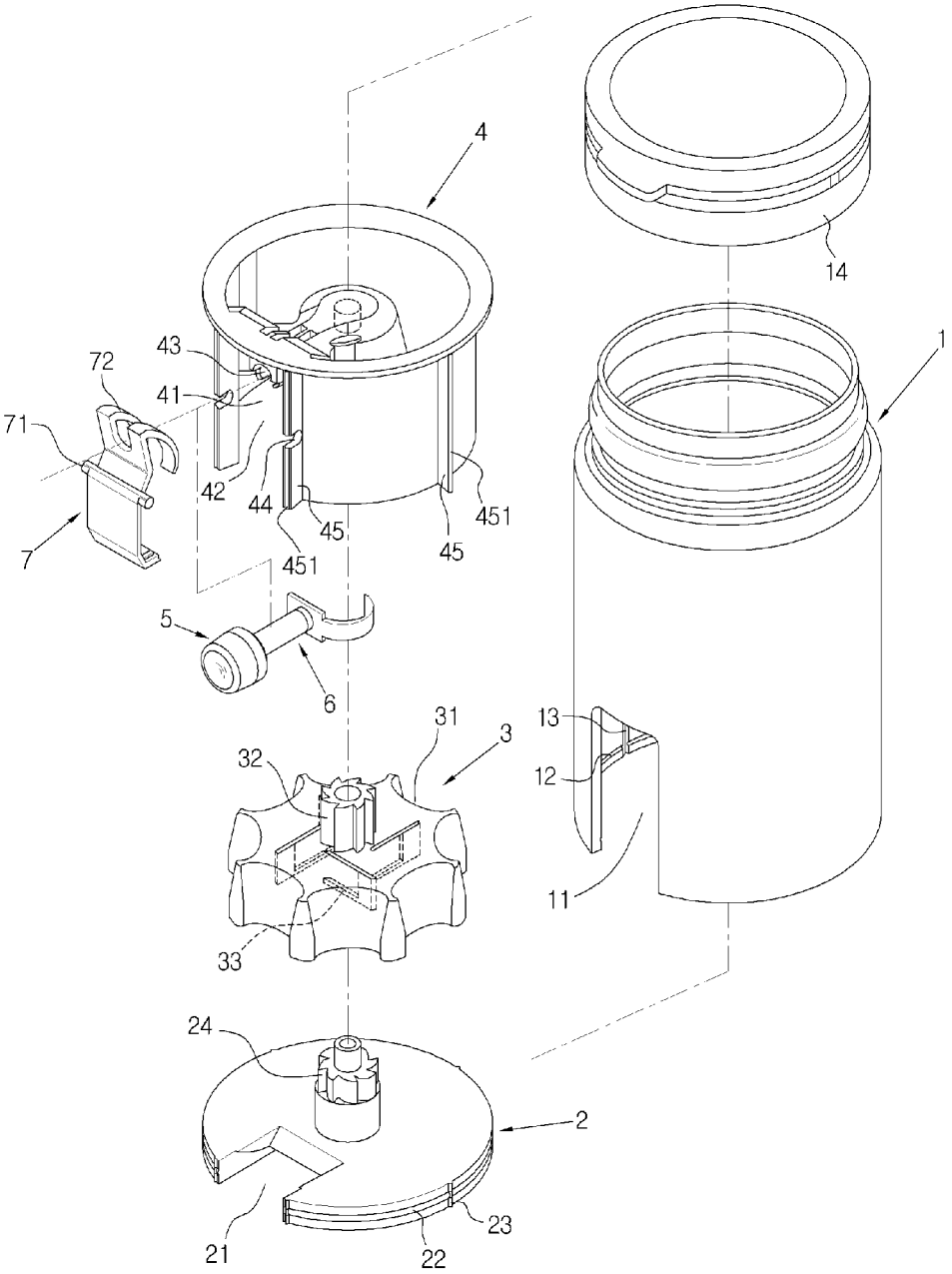
FIG. 1 is an exploded perspective view of a dispenser for food or medicine according to the present invention.

<Explanation of essential reference numerals in drawings>

| | |
|---|---|
| 1: cylindrical main body | 2: base plate |
| 3: rotor | 4: blocking member |
| 5: button | 6: push rod |

-continued

<Explanation of essential reference numerals in drawings>

| | |
|---|---|
| 7: cover | 8: torsional spring |
| 11: cut portion | 12: circular groove |
| 13: vertical groove | 14: lid |
| 15: container | 16 Retaining jaw |
| 21: outlet | 22: circular protrusion |
| 23: vertical protrusion | 24: ratchet |
| 31: insertion recess | 32: ratchet |
| 33: elastic piece | 41: operation hole |
| 44: shaft hole | 45: rib |
| 46: recess | 451: vertical protrusion |
| 71: shaft | 72: elastic piece |

DETAILED DESCRIPTION OF THE INVENTION

Reference will be now made in detail to the preferred embodiment of the present invention with reference to the attached drawings.

Figure 3:
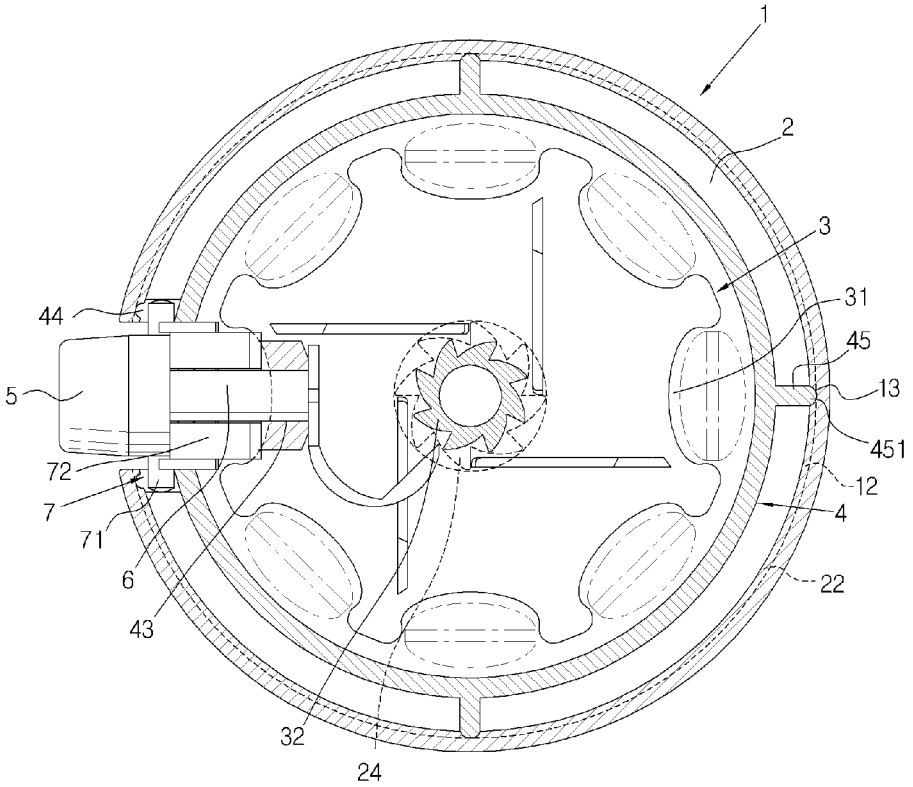
FIG. 3 is a vertically sectional view showing a combined state of the dispenser for food or medicine according to the present invention.

FIG. 1 is an exploded perspective view of a dispenser for food or medicine according to the present invention, and FIG. 3 is a vertically sectional view showing a combined state of the dispenser. The reference numeral 1 designates a cylindrical main body, 2 designates a base plate, 3 designates a rotor, 4 designates a blocking member, 5 designates a button, 6 designates a push rod, and 7 designates a cover, and they are essential components of the dispenser.

Out of the components of the dispenser, the button 5 and the push rod 6 are integrated, and an elastic piece 72 for providing a restoring force to return the integrated button 5 and push rod 6 to their original state is formed integrally to the cover 7. A joining structure among the blocking member 4 for supporting the rotor 3 and guiding the contents into an insertion hole 31 of the rotor 3, the base plate 2, and the cylindrical main body 1 is simply improved so as to provide convenience in assembly.

Figure 5:
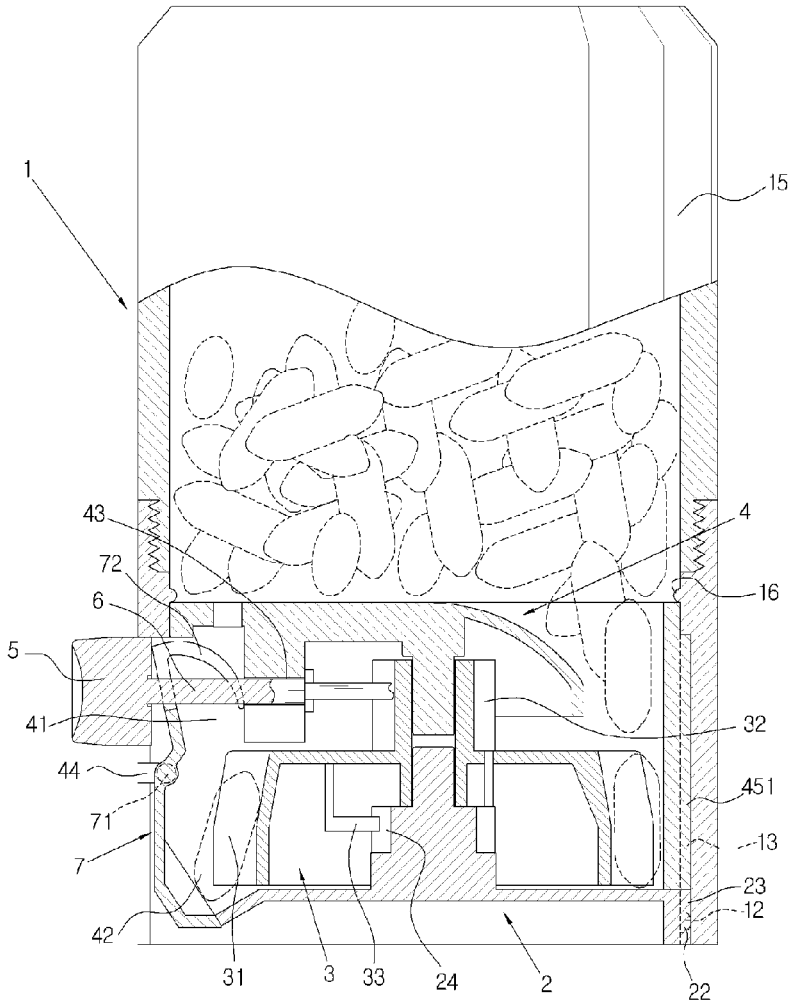
FIG. 5 is a sectional view showing a cylindrical main body of the dispenser for food or medicine according to another preferred embodiment of the present invention.

As shown in FIG. 1, the cylindrical main body 1 for receiving the contents of food or medicine has a cut portion 11 formed at a lower portion for operating the cover 7, is opened at the lower part, and has a lid 14 joined to the upper part thereof so that the main body 1 is refilled with the contents through the lid 14. Moreover, the cylindrical main body 1 is not restricted to the form that the main body 1 is refilled with the contents through the lid 14, but may adopt a structure that the cylindrical main body 1 is divided in such a way as to be screw-coupled as shown in FIG. 5, so that a separately provided container 15 can be directly joined.

In addition, the cylindrical main body 1 has a circular groove 12 and a plurality of vertical grooves 13 formed at the lower part of the inner face so that the blocking member 4 in which the button 5, the push rod 6 and the cover 7 are joined together and the base plate 2 to which the rotor 3 is joined can be assembled conveniently.

Next, the base plate 2 has an outlet 21 formed at one side in order to discharge the contents dropping out, a ratchet 24 formed at the center and protruding upward, and a circular protrusion 22 and a vertical protrusion 23 formed on the circumference. The circular protrusion 22 and the vertical protrusions 23 are respectively fit and fixed to the circular groove 12 and the vertical grooves of the cylindrical main body 1.

Next, the rotor 3 rotatably joined to the base plate 2 has a plurality of insertion recesses 31 formed on the circumference at regular intervals, a ratchet 32 formed at the center of the upper part, and an elastic piece 33 formed on the inner face of the lower part. The elastic piece 33 is in contact with the ratchet 24 of the base plate 2 in order to prevent a reverse rotation, and the ratchet 32 rotates the whole rotor 3 at a previously set angle in order to discharge the contents at the time of the operation of the push rod 6.

Next, the blocking member 4 is arranged above the base plate 2 and the rotor 3 to guide introduction of the contents into the insertion recesses 31 of the rotor 3, and has an operation space 41 for the button 5, the push rod 6 and the cover 7, an outlet 42, and an operation hole 43 opened at the lower side and formed at the upper part of the operation space 41 for actuating the ratchet 32 of the rotor 3 by horizontally sliding after the push rod 6 is inserted. That is, when the push rod 6 is forcedly fit to the opened lower side of the operation space 41, the push rod 6 moves horizontally in back and forth directions without being separated. Moreover, the blocking member 4 has a cylindrical circumference, and includes a plurality of ribs 45 formed vertically, a shaft hole 44 formed at the rib 45 located at the outlet 42, so that a shaft 71 of the cover 7 is rotatably inserted into the shaft hole 44. The ribs 45 respectively have vertical protrusions 451 which are respectively fit and fixed into the vertical grooves 13 of the cylindrical main body 1.

Figure 4A:
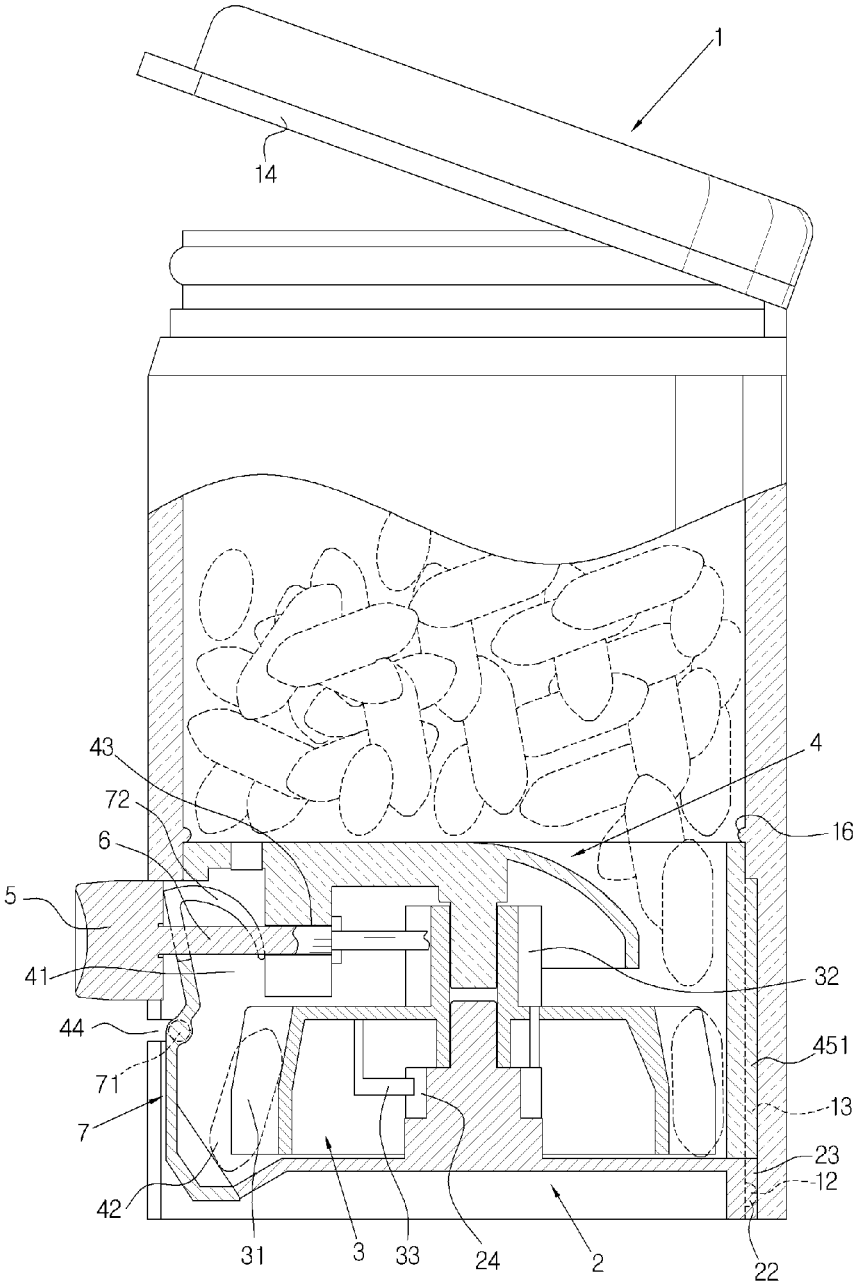
FIGS. 4*a* and 4*b* are sectional views showing an operation state of the dispenser for food or medicine according to the present invention.

Furthermore, as shown in FIG. 4*a*, the cylindrical main body 1 may further include a retaining jaw 16 formed on the inner circumferential surface so as to be fixed more stably when the vertical protrusions 451 of the blocking member 4 are fit and fixed into the vertical grooves 13 of the cylindrical main body 1.

In the meantime, the button 5 and the push rod 6 are formed integrally, and the cover 7 has a space formed at the center of the top for fitting the push rod 6 therein and an arc-shaped elastic piece 72 formed integrally at the front, so that they serve as a coil spring.

Therefore, elasticity of the elastic piece 72 operates to return the button 5, the push rod 6 and the cover 7 to their original states, and when the button 75 is pressed, the cover 7 rotates on the shaft 71 to open the outlets 21 and 42, whereby the contents are discharged out.

Figure 6:
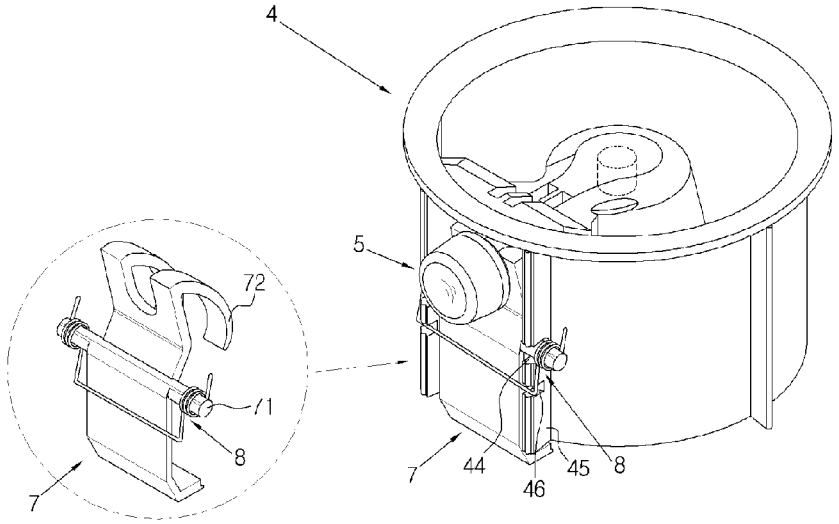
FIG. 6 is a perspective view showing a dispenser for food or medicine according to a further preferred embodiment of the present invention that a torsional spring is joined.
Figure 7:
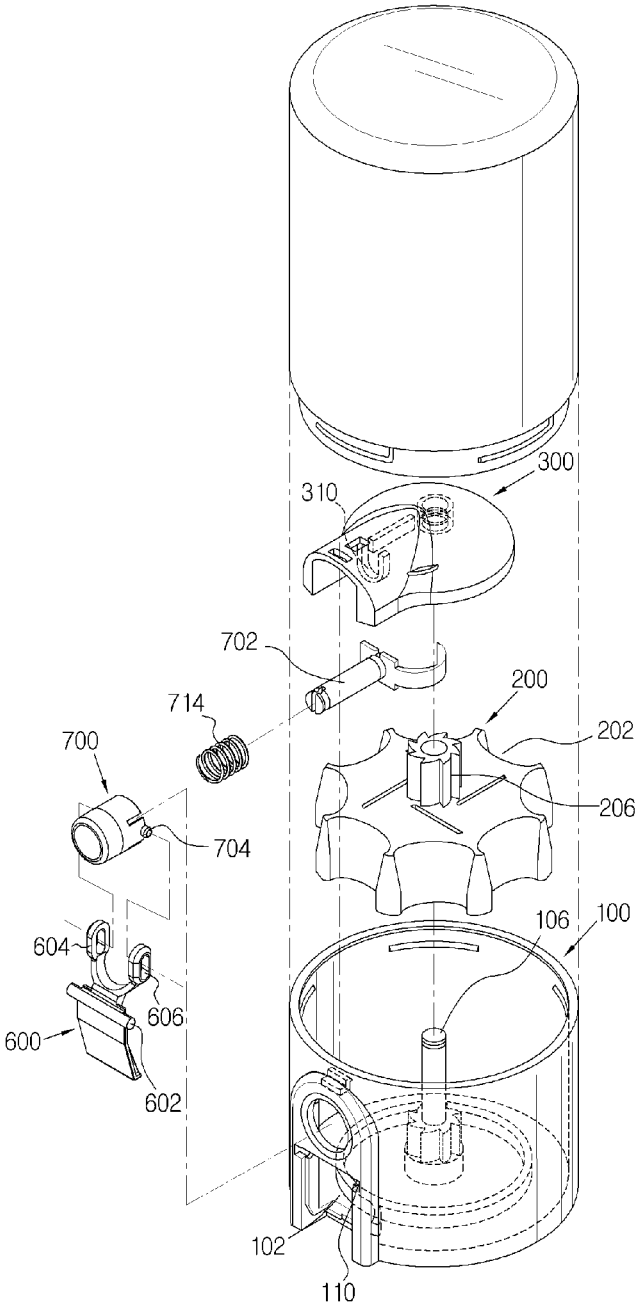
FIG. 7 is an exploded perspective view of a dispenser for food or medicine according to a prior art.

Moreover, as another preferred embodiment of the present invention, as shown in FIG. 6, a torsional spring 8 for providing elasticity is mounted on the shaft 71 of the cover 7, and recesses 46 are formed below the shaft hole 44 of the blocking member 4 for allowing the operation of the torsional spring 8 so as to improve the restoring force and sealing effect.

Next, assembling and operation processes of the dispenser for food or medicine according to the present invention having the above structure will be described.

Figure 2:
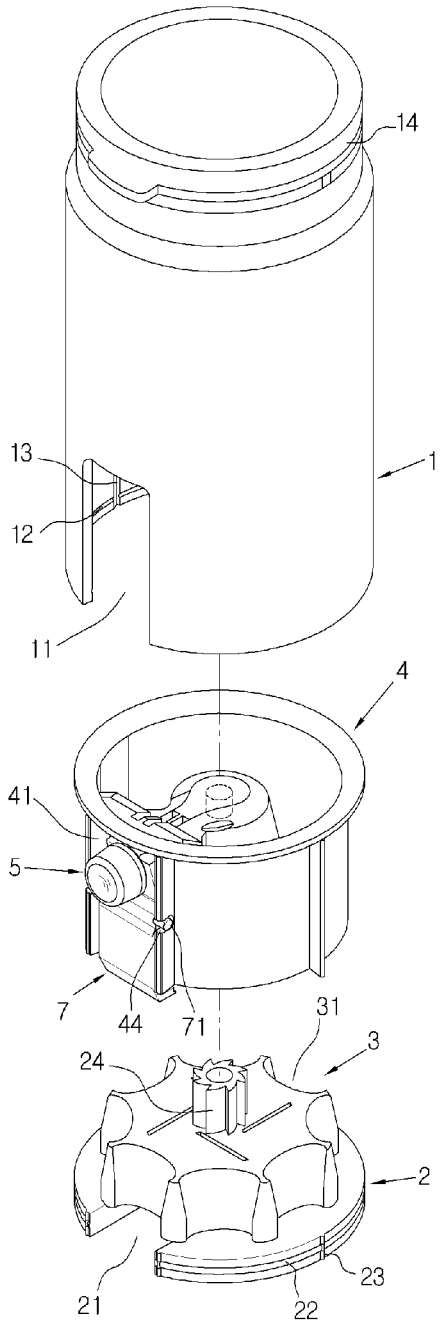
FIG. 2 is an exploded perspective view showing a combining process of the dispenser for food or medicine according to the present invention.

In a disassembled state of the components, as shown in FIG. 2, first, a user forcedly pushes the push rod 6 into the opened lower part of the operation hole 43 of the blocking member 4 so as to assemble the push rod 6 to the operation hole 43. After that, in a state where the cut portion of the elastic piece 72 of the cover 7 coincides with the push rod 6, the shaft 71 is pushed and joined into the shaft hole 44 of the blocking member 4, and then, the elastic piece 72 of the cover 7 is arranged between the front ends of the button 5 and the operation hole 43.

As described above, in the state where the button 5, the push rod 6 and the cover 7 are simply assembled to the blocking member 4, the vertical protrusions 451 formed on the ribs 45 of the blocking member 4 are respectively pushed into the vertical grooves 13 formed on the inner circumferential surface of the cylindrical main body 1 while being coincided with the vertical grooves 13, whereby an assembling position of the blocking member 4 is determined by joining between the vertical protrusions 451 and the vertical grooves 13. In the case that the retaining jaw 16 is formed on the inner circumferential surface of the cylindrical main body 1, the top of the blocking member 4 gets in contact with the retaining jaw 16, so that the blocking member 4 is fixed more stably.

Next, after the rotor 3 is put on and joined to the base plate 2 in such a manner that the elastic piece 33 of the rotor 3 gets in contact with the ratchet 24 of the base plate 2, the vertical protrusions 23 of the base plate 2 are respectively pushed into the vertical grooves 13 of the cylindrical main body 1 while being coincided with the vertical grooves 13, and then, the circular protrusion 22 of the base plate 2 is seated on the circular groove 12 of the cylindrical main body 1, so that the rotor 3 is fixed to the base plate 2 stably without any movement.

As described above, the button 5 and the push rod 6 are formed integrally, and the cover 7 to which the elastic piece 72 is formed integrally can be simply assembled to the blocking member 4. Furthermore, the cylindrical main body 1, the base plate 2 and the blocking member 4 are determined conveniently in their assembling positions by the vertical grooves 13, the vertical protrusions 23 and 451 and the circular protrusion 22 and can be fixed stably without any movement after being assembled.

Figure 4B:
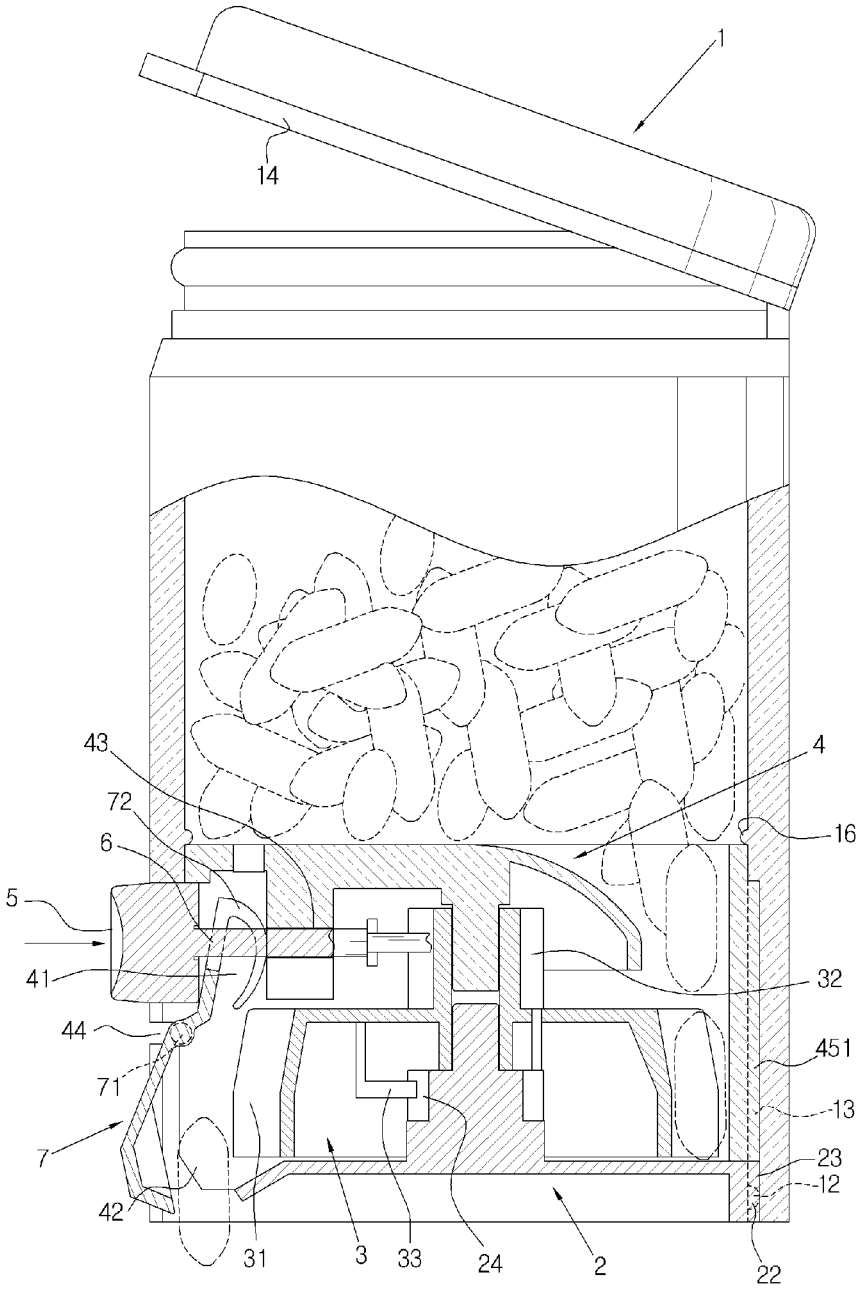

The dispenser has the assembled state through the above process as shown in FIG. 4*a*. In order to discharge the contents, when the user pushes the button 5 in the arrow direction of FIG. 4*b*, the front end of the push rod 6 pushes the ratchet 32 so as to rotate the rotor 3. The contents contained in the insertion recess 31 are moved toward the outlet 42 by the rotation of the rotor 3, and at the same time, are discharged to the outlet 42 of the rotor 3 and the outlet 21 of the base plate 2. In this instance, the elastic piece 33 of the rotor 3 gets in contact with the ratchet 32 of the fixed base plate 2 so as to prevent the reverse rotation of the rotor.

When the button 5 is moved in order to discharge the contents, because the elastic piece 72 of the cover 7 is in a compressed state and rotates on the shaft 71 so that the outlet is opened by the lower end portion of the cover 7, the contents can be discharged out smoothly.

As described above, after the contents are discharged out completely, when the power applied to the button 5 is removed, the push rod 6, the button 5 and the cover 7 are returned to their original states by the restoring force of the elastic piece 72 of the cover 7, so that the outlet 42 is closed to thereby seal the inside of the dispenser.

Additionally, in order to increase convenience in use, as shown in FIG. 4*a*, the lid 14 may be mounted on the top of the cylindrical main body 1 so as to refill the contents, or alternatively, as shown in FIG. 5, the cylindrical main body 1 may be partitioned and the container 15 is screw-coupled to the cylindrical main body 1 so as to discharge the contents.

In addition, as shown in FIG. 6, the torsional spring 8 may be added to the cover 7 in order to increase the restoring force and the contact force of the outlet 42, so that the dispenser can prevent oxidation and deterioration of the contents.

Therefore, the dispenser for food or medicine according to the present invention can remarkably improve productivity and assemblability of the components because the button 5 and the push rod 6 are formed integrally, the elastic piece 72 in lieu of the conventional coil spring is formed integrally with the cover 7, and the blocking member 4, the base plate 2 and the cylindrical main body 1 are joined together through the protrusion-groove structure.

While the present invention has been particularly shown and described with reference to the preferred embodiments thereof, it will be understood by those of ordinary skill in the art that the present invention is not limited to the attached drawings and structures and actions described in the preferred embodiments. Therefore, it will be also understood by those of ordinary skill in the art that various changes, modifications and equivalents may be made therein without departing from the technical idea and scope of the present invention.

The invention claimed is:

1. A dispenser for food or medicine, which includes:

a cylindrical main body (1) for receiving contents such as food or medicine;

a base plate (2) for closing a lower end of the cylindrical main body (1);

a rotor (3) rotatably joined to the base plate (2);

a blocking member (4) arranged above the base plate (2) and the rotor (3) for guiding introduction of the contents into insertion recesses (31) of the rotor (3) and providing an outlet (42) and an operation space (41) for a button (5), a push rod (6) and a cover (7); and the button (5), so that when a user presses the button (5), the contents inserted into the insertion recesses (31) formed in the circumference of the rotor (3) are discharged to outlets (21, 42) formed at sides of the cylindrical main body (1), the base plate (2) and the blocking member (4) while the rotor (3) joined to the inside of the cylindrical main body (1) rotates at a previously set angle, wherein the button (5) and the push rod (6) are formed integrally, an operation hole (43) is formed in the upper part of the operation space (41) of the blocking member (4) so that the push rod (6) slides horizontally to operate the rotor (3) after being inserted into the operation hole (43), the blocking member (4) is formed in a cylindrical shape, a plurality of ribs (45) are formed in a vertical direction, a shaft hole (44) to which a shaft (71) of the cover (7) is rotatably inserted is formed in the rib (45) located at the outlet (42), and the cover (7) has a space formed at the center in order to insert the push rod (6) into the space and an arc-shaped elastic piece (72) formed integrally with the front side of the cover (7), whereby the button (5), the push rod (6) and the cover (7) are returned to their original states by elasticity of the elastic piece (72) and the cover (7) is rotated to open the outlets (21, 42) when a user presses the button (75), and wherein the cylindrical main body (1) has a circular groove (12) and a plurality of vertical grooves (13) formed at the lower part of the inner circumferential surface, the blocking member (4) has vertical protrusions (451) formed on the ribs (25) in such a way as to be coincided with and fit to the vertical grooves (13) of the cylindrical main body (1), and the base plate (2) has a circular groove (22) and vertical protrusions (23) formed on the circumference thereof in such a way as to be fit and fixed to the circular groove (12) and the vertical grooves (13) of the cylindrical main body (1).

2. The dispenser for food or medicine according to claim 1, wherein a torsional spring (8) for providing elasticity is mounted to the shaft (71) of the cover (7), and the blocking member (4) has recesses (46) formed below the shaft hole (44) of the blocking member (4) for allowing the operation of the torsional spring (8).

* * * * *